US008959725B2

(12) United States Patent
Tam et al.

(10) Patent No.: US 8,959,725 B2
(45) Date of Patent: Feb. 24, 2015

(54) FASHION ACCESSORY TOOL

(76) Inventors: Hannah Josephine Tam, San Francisco, CA (US); David Shui-Sang Tam, San Francisco, CA (US); Maria Victoria O. Perez, San Francisco, CA (US)

( * ) Notice: Subject to any disclaimer, the term of this patent is extended or adjusted under 35 U.S.C. 154(b) by 221 days.

(21) Appl. No.: 13/433,076

(22) Filed: Mar. 28, 2012

(65) Prior Publication Data

US 2013/0254974 A1 Oct. 3, 2013

(51) Int. Cl.
*A44B 9/00* (2006.01)
*A41D 27/08* (2006.01)

(52) U.S. Cl.
USPC ..... 24/351; 24/329; 24/353; 2/244

(58) Field of Classification Search
CPC ..... A45F 5/08; A44C 1/00
USPC ..... 24/351, 13, 707.7, 6, 3.11, 3.12, 5, 60, 24/51, 352–358, 329, 331, 335, 338, 340, 24/509–510; 63/20, 43; 132/275–282, 132/284; 2/244, 245; 402/57
See application file for complete search history.

(56) References Cited

U.S. PATENT DOCUMENTS

| | | | | |
|---|---|---|---|---|
| 345,794 | A | 7/1886 | Master | |
| 560,290 | A * | 5/1896 | Wezen et al. | 24/60 |
| 686,789 | A * | 11/1901 | Webb | 16/17 |
| 726,975 | A * | 5/1903 | Neithercott | 24/5 |
| 887,149 | A * | 5/1908 | Tarnow | 132/275 |
| 921,663 | A * | 5/1909 | Bateman | 24/66.11 |
| 985,075 | A * | 2/1911 | Tarnow | 24/329 |
| 1,041,664 | A * | 10/1912 | Olson | 150/134 |
| 1,085,552 | A * | 1/1914 | Dinuccio | 24/351 |
| 1,110,446 | A * | 9/1914 | Lange | 24/329 |
| 1,234,308 | A * | 7/1917 | Droll | 24/353 |
| 1,313,137 | A * | 8/1919 | Tarnow | 132/275 |
| 1,666,662 | A * | 4/1928 | Nadel | 24/6 |
| 1,860,384 | A * | 5/1932 | Cocks | 211/30 |
| 2,065,903 | A * | 12/1936 | Levy | 24/332 |
| 2,516,999 | A | 8/1950 | Kuntz | |
| 2,932,869 | A * | 4/1960 | Neubig | 24/354 |
| 3,362,052 | A * | 1/1968 | Uchida | 24/510 |
| 3,412,739 | A * | 11/1968 | Thatcher | 132/278 |
| 3,817,260 | A | 6/1974 | Kleine | |
| 3,982,305 | A * | 9/1976 | Meyer | 24/353 |
| 5,062,436 | A | 11/1991 | Emsellem | |
| 5,303,724 | A | 4/1994 | Anzivino | |
| 5,379,783 | A | 1/1995 | Healzer et al. | |
| 6,386,208 | B1 | 5/2002 | Reid | |
| 7,644,717 | B2 * | 1/2010 | Hsu | 132/279 |
| 2002/0124862 | A1 | 9/2002 | Porter et al. | |
| 2007/0256701 | A1 | 11/2007 | Benz | |

FOREIGN PATENT DOCUMENTS

| | | |
|---|---|---|
| FR | 2 697 415 A1 | 5/1994 |
| GB | 03102 | 2/1916 |

(Continued)

OTHER PUBLICATIONS

International Search Report dated May 28, 2013 for International Application No. PCT/US2013/032817.

(Continued)

*Primary Examiner* — Robert J Sandy
*Assistant Examiner* — Abigail Morrell
(74) *Attorney, Agent, or Firm* — Beyer Law Group LLP

(57) ABSTRACT

A fashion accessory tool that can transform a piece of fabric. The fashion accessory tool allows a piece of fabric to be secured to a garment and adjusted after it has been secured to the garment. The piece of fabric can be woven through the fashion accessory tool and then secured in the tool with deformable features. The fashion accessory tool can be pinned to a garment and the fabric can be adjusted and styled after the fashion accessory tool is pinned.

19 Claims, 7 Drawing Sheets

(56) References Cited

FOREIGN PATENT DOCUMENTS

| | | |
|---|---|---|
| GB | 144 679 | 12/1920 |
| WO | WO 90/07287 | 7/1990 |
| WO | WO 94/09667 | 5/1994 |

OTHER PUBLICATIONS

Written Opinion dated May 28, 2013 for International Application No. PCT/US2013/032817.

Vintage 1913 hair clip purchased by one of the inventors in Mar. 2011.

* cited by examiner

FASHION ACCESSORY TOOL

BACKGROUND

1. Field of the Described Embodiments

The described embodiments relate generally to fashion accessories. More particularly, apparatuses and methods for securing fabric in a decorative manner are described.

2. Description of the Related Art

A traditional brooch or jewelry pin is typically used to fasten fabrics together and is typically more decorative than functional. When used to fasten fabric, a traditional brooch restrains the fabric, thereby eradicating any fluidity in the fabric, after it is pinned. A brooch or jewelry pin does not allow for securing fabric in a wide range of styles. Although there have been several variations to the brooch or jewelry pin over the years, there are still limitations to the brooch.

A brooch or pin has a tendency to dangle forward and not stay flat or upright because the fabric is solely supported by the pin portion of the brooch that is used to attach the fabric to another piece of fabric, such as a garment. The pin of a traditional brooch does not have a wide base to provide enough support to prevent the pin from dangling forward. The pin on the traditional brooch is typically located in the center of the brooch, creating a wide distance from the top and bottom edges of the decorative frame of the brooch, resulting in the brooch pulling forward when pinned to fabric.

A traditional brooch or jewelry pin cannot accommodate a variety of fabrics with varying strengths and durability. Typically, the size and strength of the pin of the traditional brooch or jewelry pin determines the type of fabric that can be attached. A traditional brooch or jewelry pin does not allow a wide range of fabrics to be attached together. A small pin at the back of the brooch or jewelry pin will not support thicker fabrics and will only cause the fabric to be detached as continued movements from the wearer occur. A much larger pin, on the other hand, would cause a flimsy fabric to slip and tear over time. The traditional brooch or jewelry pin does not allow the fabric to retain its fluidity and versatility as it merely restrains the fabric. Thus, once the traditional brooch or jewelry pin is fastened, the fabric cannot be adjusted significantly.

The traditional brooch or jewelry pin is meant only to enhance a garment but cannot transform the garment or transform a simple piece of fabric into a wearable item. Thus, there is a need for a tool that can not only enhance a garment but also transform a the garment or even a simple piece of fabric.

SUMMARY OF THE DESCRIBED EMBODIMENTS

According to an aspect, a method is described for of securing a first piece of fabric to a second piece of fabric. A fashion accessory tool is provided. The fashion accessory tool includes a pin mechanism attached to an arm capable of pivoting with respect to a base plate at a first end of the arm. The arm has at least two openings. The first piece of fabric is secured in the fashion accessory tool by pivoting the arm to fasten a second end of the arm to the base plate. The fashion accessory tool and the first piece of fabric are then secured to the second piece of fabric by using the pin mechanism to pin the fashion accessory tool to the second piece of fabric.

According to another aspect, a fashion accessory tool is described for securing and adjusting fabric. The fashion accessory tool includes a base plate, an arm, a deformable band positioned between the arm and the base plate, and a pin mechanism pivotally attached to the arm. The base plate has a first end and a second end. The arm has two openings. A first end of the arm is pivotally coupled with the first end of an under surface of the base plate and a second end of the arm has a fastener configured to engage with a corresponding fastener on the second end of the base plate. The deformable band, deforms when the fabric is passed through the fashion accessory tool.

According to yet another aspect, a fashion accessory tool is described. The fashion accessory tool includes a base plate having a first end and a second end, an arm having a first end and a second end, a deformable band positioned between the arm and the base plate, and a pin mechanism. The first end of the arm is pivotally coupled with the first end of the base plate and the second end of the arm has a fastener configured to engage with a corresponding fastener on the second end of the base plate. The base plate is substantially parallel to the arm and the band deforms when a piece of fabric is passed through the fashion accessory tool. A first end of the pin is pivotally attached to an end of the arm and a second end of the pin is configured to engage a feature attached to the other end of the arm.

BRIEF DESCRIPTION OF THE DRAWINGS

The embodiments will be readily understood by the following detailed description in conjunction with the accompanying drawings, wherein like reference numerals designate like structural elements, and in which.

DESCRIBED EMBODIMENTS

In this paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

Figure 1:
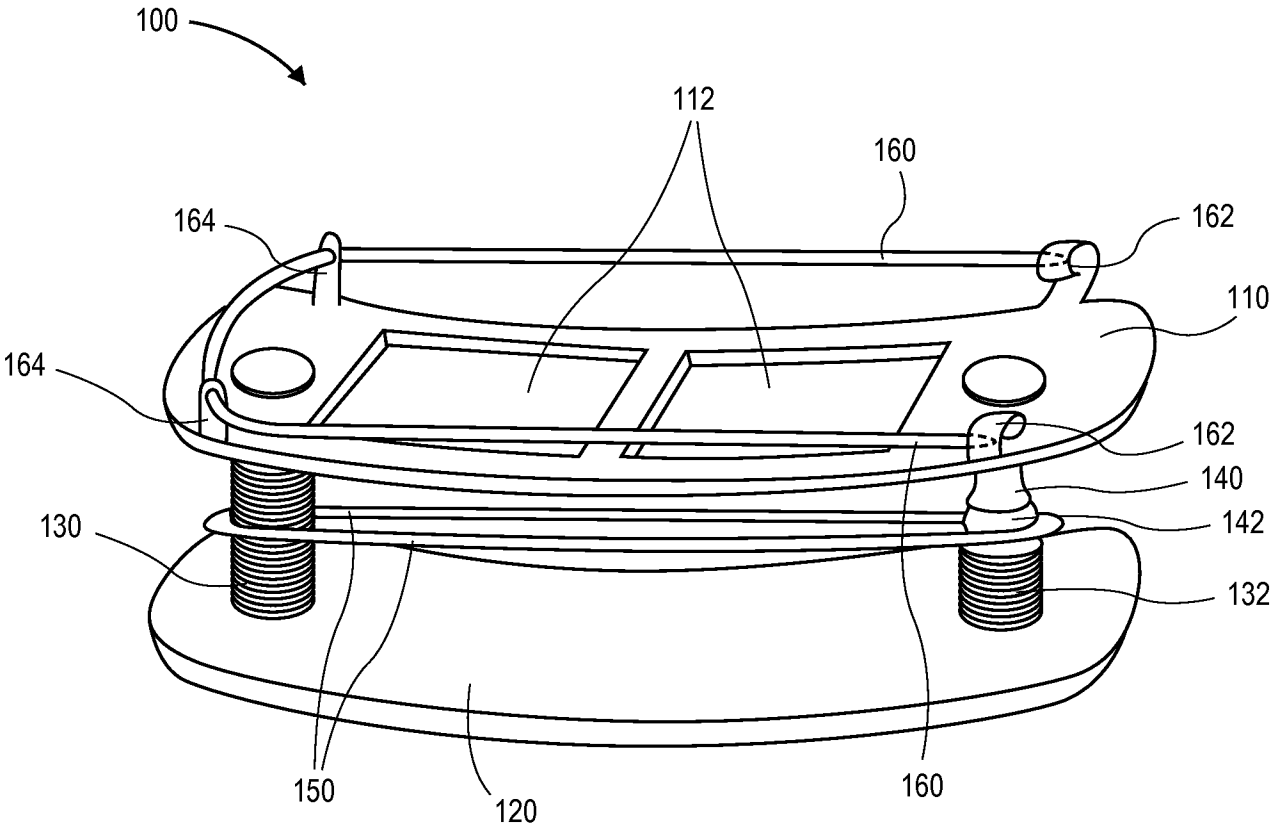
FIG. 1 shows a bottom perspective view of a fashion accessory tool in accordance with described embodiments.

FIG. 1 is a perspective bottom view of a fashion accessory tool 100. The fashion accessory tool 100 can attach a piece of fabric (such as, but not limited to scarves, body wraps and shawls) together, while providing the fabric with flexibility and ease for creating a dynamic, versatile fashion style. Fabric that is secured by the fashion accessory tool 100 can be shirred, cowled, draped, creased or flounced after it is pinned. The wearer can also use the fashion accessory tool 100 to transform a simple piece of fabric into a wearable item, such as, for example, a dress or a blouse. The fashion accessory tool 100 can also breathe life into an existing wardrobe by providing versatility in that it can give shape to a loose fitting dress or change the look of a dress with an added burst of shears and a draped hemline without the cost and expense of a tailor. Further, the fashion accessory tool 100 can transform a piece of fabric without permanence unlike traditional sewn garments. A piece of fabric shaped and/or secured by the fashion accessory tool 100 can be used again to create a different garment using the fashion accessory tool 100. Additionally, the fashion accessory tool 100 can also be used as a custom-placed removable belt loop to allow materials such as a belt or a sash to go through the belt loop and stay in place.

As described above, the traditional brooch and other fashion accessories that are currently commercially available do not allow the user to transform fabrics into wearable items as they do not contain the dual functions of the fashion accessory tool 100. The fashion accessory tool 100 can manipulate fabric into various fashion styles as well as securely attach the fabric to a garment. As discussed in more detail below, the fashion accessory tool 100 can easily convert a piece of fabrics into different garments or transform an existing garment.

As shown in FIG. 1, the fashion accessory tool can include an upper arm 110 that is attached to a base plate 120. The top surface of the base plate 120 can be provided with an aesthetically pleasing or decorative appearance, as it is the top surface of the base plate 120 that is seen when the fashion accessory tool 100 is worn. According to the embodiment shown in FIG. 1, the base plate 120 is attached to the upper arm 110 with spring 130. It will be understood that, in other embodiments, the base plate 120 can be attached directly to the upper arm 110 or indirectly using other means. As will be explained in more detail below, the upper arm 110 on the fashion accessory tool 100 can be opened to allow the fabric to pass through in between the upper arm 110 and an inner deformable band 150. The upper arm 110 can be closed (secured to the base plate 120 on both ends) to secure the fabric between the upper arm 110 and deformable band 150. The base plate 120 can be formed of any suitable material, such as, for example, metal, glass, rubber, paper mache, fabric, wood, plastic, composite material, leather, clay, and metal clay.

Figure 2:
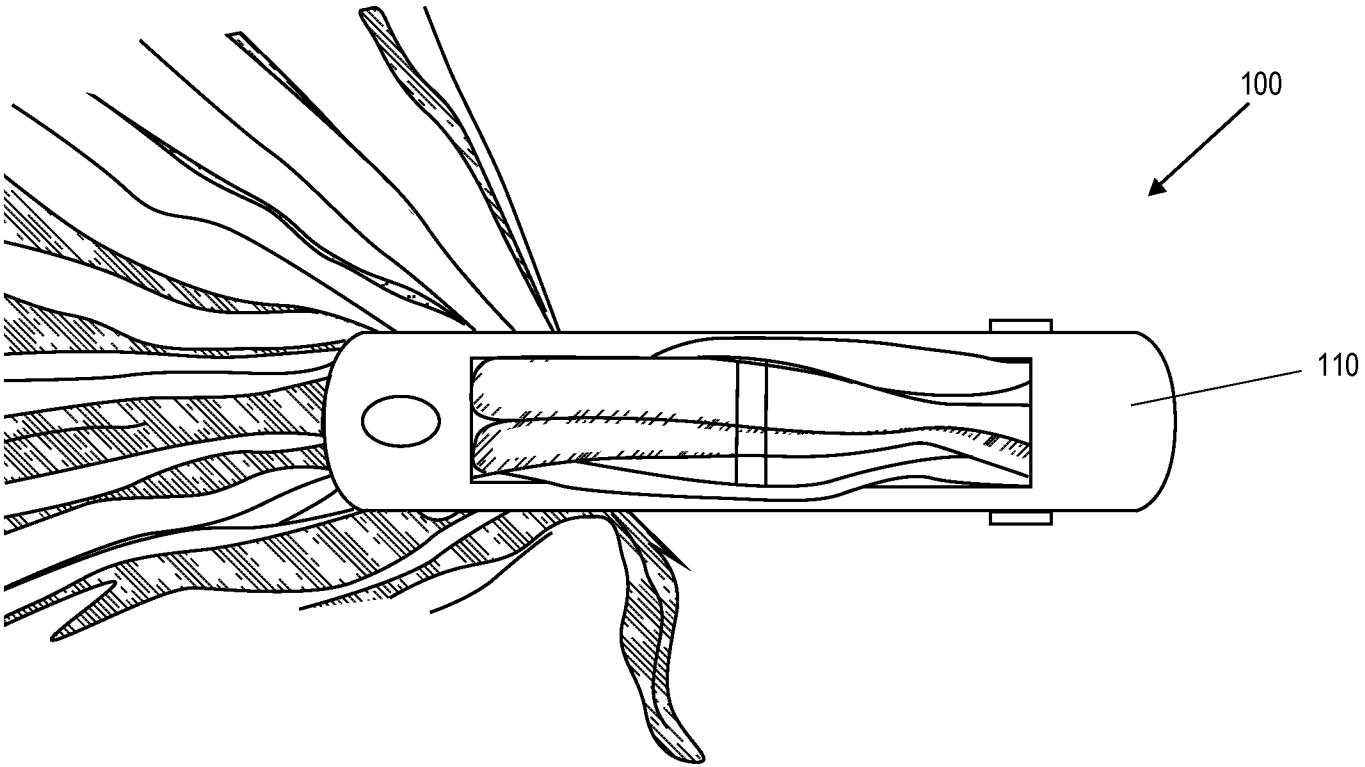
FIG. 2 is a bottom view of the fashion accessory tool shown in FIG. 1 with fabric passed though the openings of the upper arm.

According to the embodiment illustrated in FIG. 1, the upper arm 110 can include two openings 112. The openings 112 allow the fashion accessory tool 100 to transform the design of an existing garment by simply pulling a portion of the wearable item (blouse, dress or skirt) and weaving the pulled portion in and out of the openings 112 of the upper arm, as shown in FIG. 2. For example, the fabric can be inserted into one opening 112 from a top side of the upper arm 110 to the bottom side of the upper arm. The fabric can then be woven by inserting it into the other opening 112 from the bottom side of the upper arm 110 and passed through the opening 112 to the top side of the upper arm 110. The pulled portion can then be pinned, using the fashion accessory tool, on to the wearable item to secure it to the wearable item. Weaving the fabric in and out of the two openings 112 can provide the wearable item (blouse, dress or skirt) with, for example, a burst of sheers, a draped hemline or a more shapely dress (without the cost and expense of a tailor). While the openings 112 are shown as rectangular openings in the illustrated embodiment, it will be understood that the openings 112 can be any suitable shape and size for fabric to be woven therethrough.

The fashion accessory tool 100 can allow the fabric to be further styled even after it is pinned and secured to a garment. There is movement to the fabric after it is attached and allows the wearer to create a variety of styles. As described in more detail below, the fabric can be still be moved and further adjusted even after the fashion accessory tool 100 is pinned to a garment, as the fabric is secured to the garment indirectly via the fashion accessory tool 100. Thus, the fabric is not fixed to the garment nor is the fabric faxed to the fashion accessory tool 100. As is described in more detail below, the fabric can also be woven and passed through openings of the fashion accessory tool 100 and held in place with features that can deform and extend.

In addition to the fashion accessory tool 100 being a tool that can provide fabric with flexibility and ease for creating a dynamic and versatile fashion piece, the fashion accessory tool 100 can also be used as a removable belt loop, with the base plate 120 serving as a belt buckle. The fashion accessory tool 100 can serve as a removable belt loop to secure the likes of, but not limited to, a cord, belts, sash, tie or scarf, which can be passed through the fashion accessory tool 100 and held in place between the upper arm 110 and a deformable band 150 when the upper arm 110 is secured to the base plate 120 at both ends. A fashion accessory tool 100 that serves to be used as a belt loop is removable and can be placed in various areas of the clothing by simply pinning the fashion accessory tool 100 to the garment and sliding the cord, belt or the like through the fashion accessory tool 100. The cord, belt, or the like can be secured by using a pin mechanism. The use of the fashion accessory tool 100 as a removable belt loop can effectively and dramatically change the look of an outfit. For example, using the fashion accessory tool 100 as described herein, dresses can be transformed to have drop waistlines and scarves can be draped onto hips. Thus, the fashion accessory tool 100 can be not only decorative but also functional.

Figure 3:
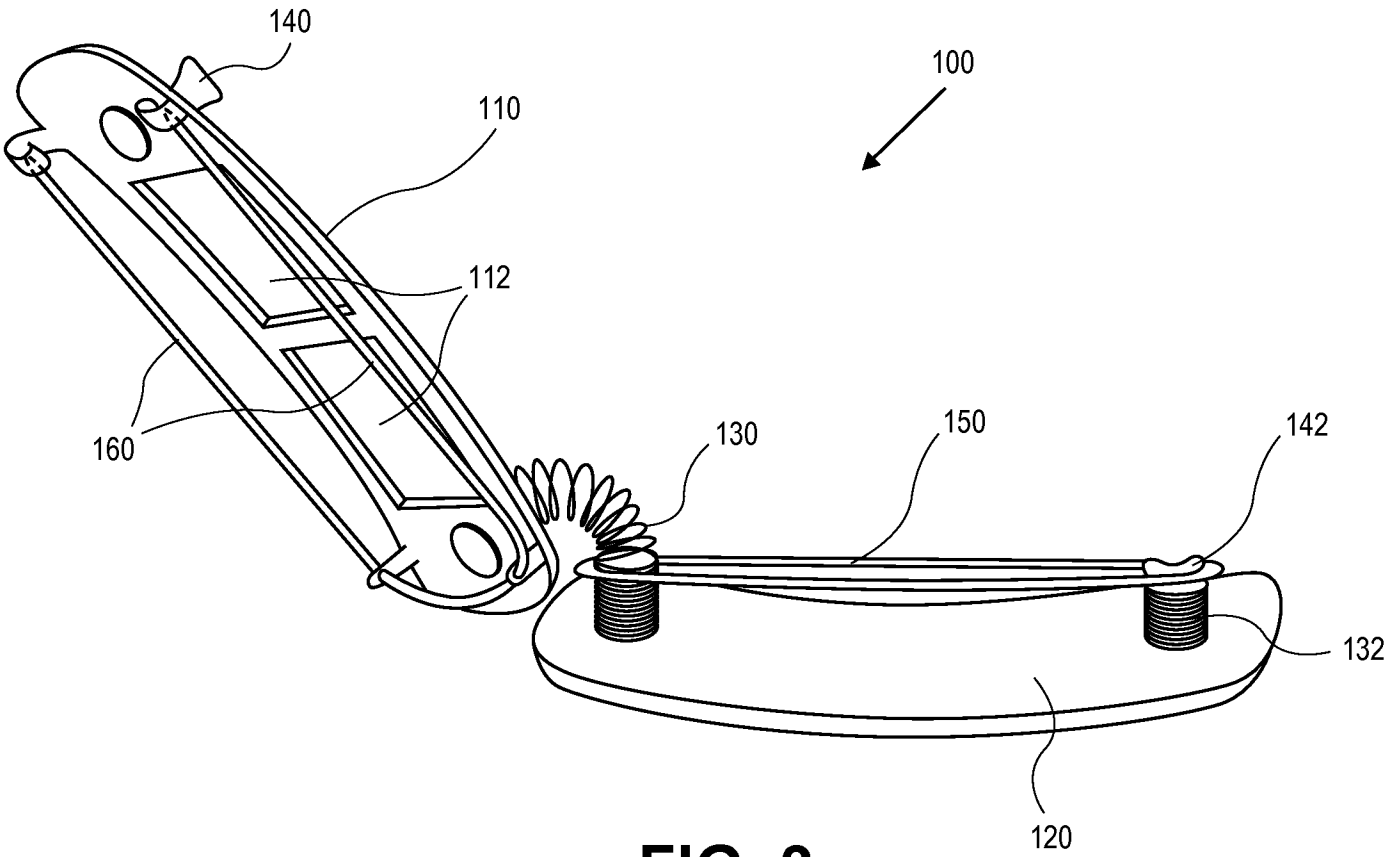
FIG. 3 is a perspective view of the fashion accessory tool shown in FIG. 1 in with the upper arm an open position.

The fashion accessory tool 100 can easily allow a simple piece of fabric to be transformed into a myriad of fashion styles, ranging from a laid back look to classy elegance, after it is pinned. The upper arm 110 on the fashion accessory tool 100 can be opened, as shown in FIG. 3, to allow the fabric to pass through in between the upper arm 110 and an inner deformable band 150. For example, a helical extension spring 130 attaching the upper arm 110 to the base plate 120 can allow the upper arm 110 to open at a wide angle, as shown in FIG. 3.

As shown in the illustrated embodiment, a helical extension spring 130, 132 can be attached to each end of the base plate 120. The upper arm 110 can also be attached to helical extension spring 130. As will be explained in more detail below, the helical extension spring 130 can engage helical extension spring 132 via a fastener arrangement such that the fashion accessory tool 100 can accommodate thicker fabrics. For thicker fabrics, the helical extension springs 130, 132 can extend to accommodate the fabric. In such cases, the height of the fashion accessory tool 100 increases with the extension of the helical extension springs 130, 132.

Figure 4:
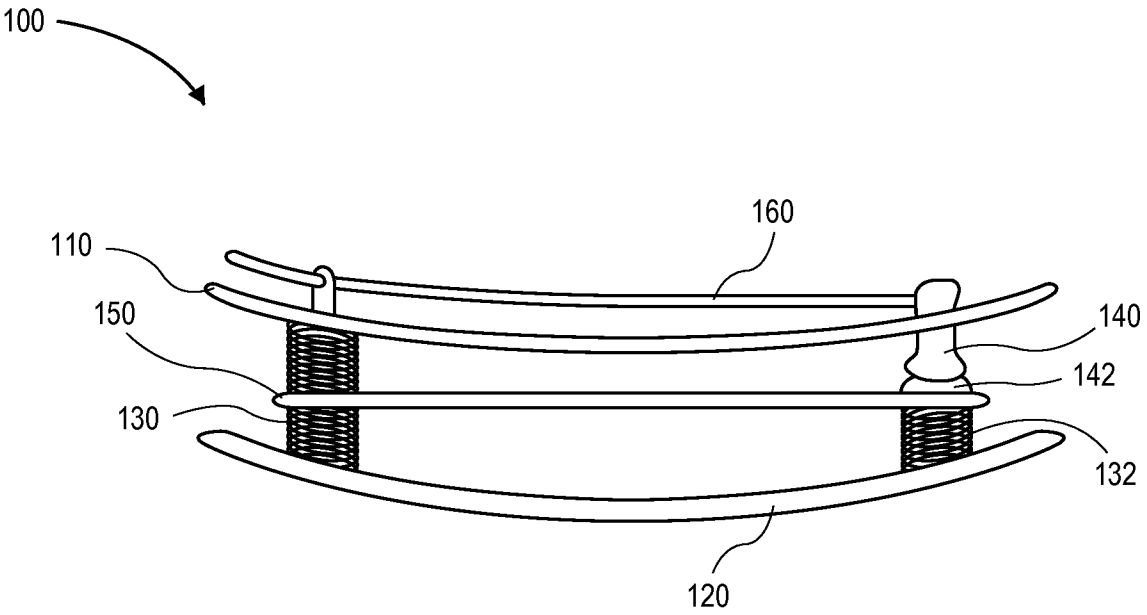
FIG. 4 is a side view of the fashion accessory tool shown in FIG. 1.

The upper arm 110 can be provided with a fastener to fasten the upper arm 110 to the base plate 120 when the fashion accessory tool 100 is in the closed position, as shown in FIG. 4. According to the embodiment shown in FIG. 1, once the fabric has passed through and is set in the desired position, a fastener, such as snap stud 140, which is attached to one end of the upper arm 110, can be engaged to a snap socket 142, which is attached to the top of the helical extension spring 132 to engage the open end of the upper arm 110 with the base plate 120 to secure the fabric. It will be understood that other securing mechanisms can be used in place of a snap stud and snap socket arrangement. For example, the securing mechanism can be a hook and eye mechanism, elastic bands, magnetic arrangement, buttons, latch, clasp, cuff and link locking mechanism, ball and slit locking mechanism, interlocking rings or ribbons, insertion locking mechanism, or the like.

To secure the fabric to the garment, the dual pins 160, which are attached to the sides of the upper arm 110, are then pinned and closed. The fabric can then be manipulated to attain a desired fashion look. The fabric can be flounced, shirred, pleated and draped. In addition, the two openings 112 in the upper arm 110 can also be used to create a whole new look to an existing garment. For example, an existing dress can be transformed simply by pulling a piece of the dress or any wearable item and inserting that piece of fabric in and out of the two openings 112, thereby producing a burst of sheers and a draped hemline. Once the fabric has been pulled, the fabric can then be pinned using a pin mechanism of the fashion accessory tool 100 to secure it to a garment or another piece of fabric.

Figure 5:
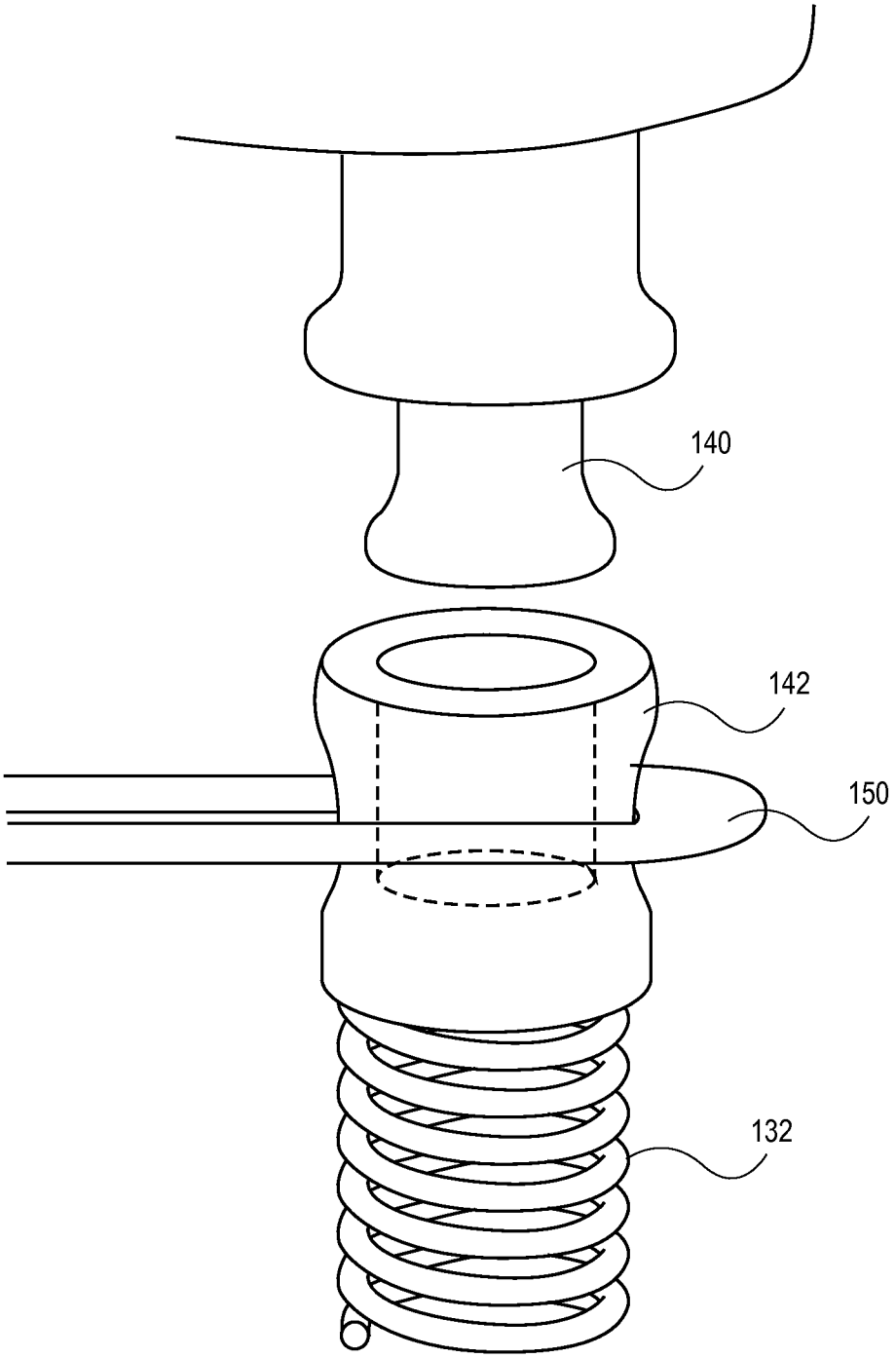
FIG. 5 shows a detailed view of a snap stud and snap socket arrangement in accordance with an embodiment.

FIG. 5 is a detailed view of an exemplary snap stud 140 and snap socket 142 arrangement of an embodiment. In the illustrated embodiment, as the upper arm 110 with a snap stud 140 is stretched on one end to allow a thicker fabric to go through, the helical extension spring 132, with the snap socket 142 on the other end, can be stretched equally to receive the snap stud 140 so that it can be engaged with the snap socket 142 to lock and secure.

The thickness of the fabric can be inconsequential with the presence of the helical extension springs 130 and 132, the upper arm 110 and an inner deformable band 150. As shown in the illustrated embodiment, the inner deformable band 150, which can be positioned between the upper arm 110 and the base plate 120, can be looped around the helical extension springs 130, 132, and can grip flimsier fabrics and tighten the hold of the fabric, depending on the thickness of the fabric and the amount of fabric. While a helical extension spring is described above, it will be understood that any suitable spring-like feature can be used for a similar purpose. The deformable band 150 can be formed of any suitable deformable material, such as, for example, rubber, magnetic band, aluminum, plastic, fabric, clay, silver, or the like.

Figure 6:
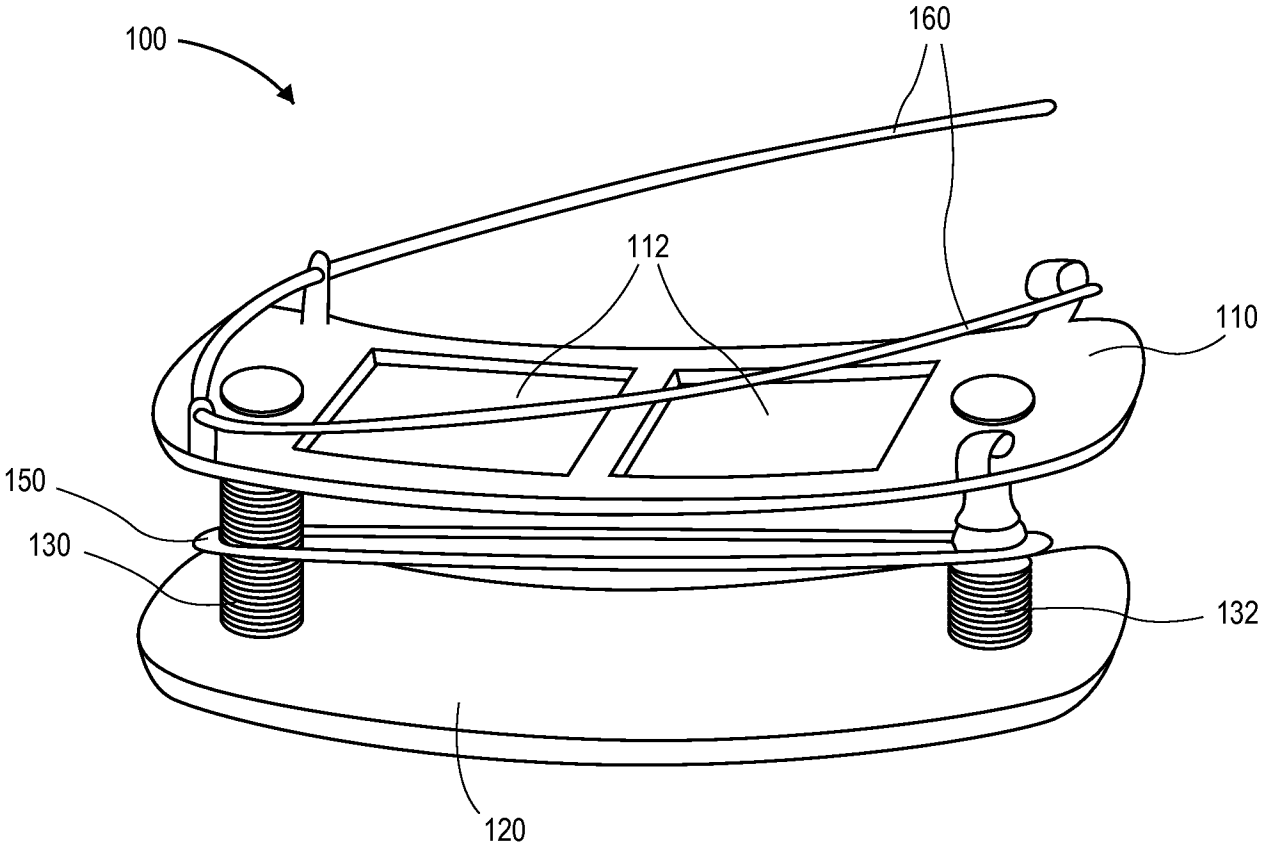
FIG. 6 is a perspective view of the fashion accessory tool shown in FIG. 1 with pins in an open position.

According to an embodiment, the pin mechanism shown can have a dual pin design. As shown in FIGS. 1 and 6, the two pins 160 can be substantially parallel to one another. In the illustrated embodiment, each of the pins 160 is positioned along a length of the upper arm 110. With the dual pin design, the distance of the pins 160 from the top and bottom edges of the decorative frame of the base plate 120 is significantly narrowed, so the fashion accessory tool 100 can stay flat in position when pinned. Furthermore, with the upper arm 110 of the fashion accessory tool 100 that contains a snap stud 140 to secure and lock with a snap socket 142 attached to the base plate 120, the weight of the fabric is distributed and therefore does not solely depend on the pins 160 for attachment. Alternatively, the pin mechanism can include only one pin.

As shown in the illustrated embodiment, the pin mechanism 160 can be continuous and U-shaped with two substantially parallel pins. The pin mechanism 160 can be rotatably engaged with the upper arm 110. As shown in FIG. 1, the pin mechanism 160 can be rotatably engaged with hinges 164 attached to the upper arm 110. The hinges 164 can be integrally formed with the upper arm 110 in an embodiment. According to another embodiment, the hinges 164 can be attached to the upper arm 110. It will be understood that, although the illustrated embodiment shows two hinges 164, some embodiments may have only one hinge and other embodiments may have more that two hinges.

The two substantially parallel pins can be squeezed together by the user to engage the free ends of the pins with the safety caps 162 to hold the pins in place in the closed position. Similarly, the user can squeeze the pins together to disengage the pins from the safety caps 162. It will be understood that other pin holding mechanisms can be used in place of the illustrated safety caps.

Figure 7:
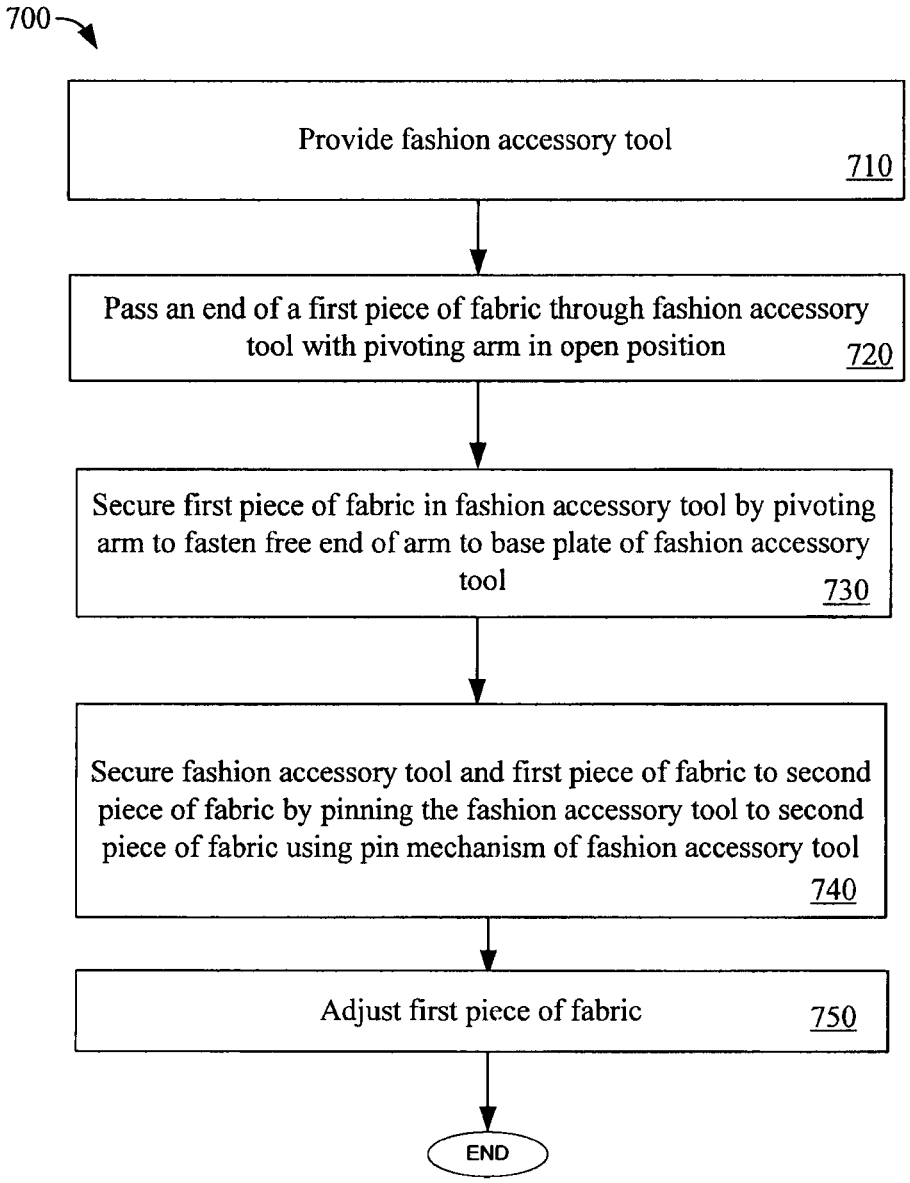
FIG. 7 is a flow diagram of a method of securing a first piece of fabric to a second piece of fabric and adjusting the first piece of fabric.

FIG. 7 is a flow chart of a method 700 of securing a first piece of fabric to a second piece of fabric, and subsequently adjusting the first piece of fabric. In 710, a fashion accessory tool is provided. The fashion accessory tool includes a pin mechanism attached to an arm capable of pivoting with respect to a base plate at a first end of the arm. In 720, the first piece of fabric is passed through the fashion accessory tool with the pivoting arm in the open position. The arm can also have at least two openings through which fabric can be woven. An end of the first piece of fabric can also be woven through the at least two openings. In 730, the first piece of fabric is then secured in the fashion accessory tool by pivoting the arm to fasten a second end of the arm to the base plate and securing the first piece of fabric between the arm and an inner deformable band. In 740, the fashion accessory tool and the first piece of fabric are secured to the second piece of fabric by using the pin mechanism to pin the fashion accessory tool to the second piece of fabric. The first piece of fabric can then be adjusted as desired in 750.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of particular embodiments, there are alterations, permutations, and equivalents, which fall within the scope of these general concepts. It should also be noted that there are alternative ways of implementing the methods and apparatuses of the present embodiments. It is therefore intended that the following appended claims be interpreted as including all such alterations, permutations, and equivalents as fall within the true spirit and scope of the described embodiments.

What is claimed is:

1. A fashion accessory tool for securing and adjusting fabric, comprising:

a base plate having a first end and a second end;

an arm having two openings, wherein a first end of the arm is pivotally coupled by a first extendable feature with the first end of an under surface of the base plate and a second end of the arm has a fastener configured to engage with a corresponding fastener on the second end of the base plate, wherein a second extendable feature is between the second end of the base plate and the fastener on the second end of the base plate;

a deformable band positioned between the arm and the base plate, wherein the band engages the extendable features and is substantially a same length as the base plate and wherein the band deforms when the fabric is passed through the fashion accessory tool; and a pin mechanism pivotally attached to the arm.

2. The fashion accessory tool of claim 1, wherein each of the extendable features is a spring mechanism coupled on one end to the under surface of the base plate and on the other end to the arm.

3. The fashion accessory tool of claim 2, wherein the fastener of the arm is a snap stud and the corresponding fastener of the base plate is a snap socket attached to the spring mechanism, wherein the spring mechanism is coupled to the arm when the snap stud engages with the snap socket.

4. The fashion accessory tool of claim 1, wherein the pin mechanism comprises two substantially parallel pins.

5. The fashion accessory tool of claim 1, wherein the pin mechanism is pivotally attached to the arm by a hinge mechanism.

6. A fashion accessory tool for securing and adjusting fabric, comprising:

a base plate haying a first end and a second end;

an arm having two openings, wherein a first end of the arm is pivotally coupled with the first end of an under surface of the base plate and a second end of the arm has a fastener configured to engage with a corresponding fastener on the second end of the base plate;

a spring mechanism coupled on one end to the under surface of the base plate and on the other end to the arm, wherein the spring mechanism is a helical extension spring;

a deformable band positioned between the arm and the base plate, wherein the band is substantially a same length as the base plate and wherein the band deforms when the fabric is passed through the fashion accessory tool; and a pin mechanism pivotally attached to the arm.

7. The fashion accessory tool of claim 6, wherein the pin mechanism comprises two substantially parallel pins.

8. The fashion accessory tool of claim 6, wherein the fastener of the arm is a snap stud and the corresponding fastener of the base plate is a snap socket attached to the helical extension spring, wherein the helical extension spring is coupled to the arm when the snap stud engages with the snap socket.

9. The fashion accessory tool of claim 6, wherein the pin mechanism is pivotally attached to the arm by a hinge mechanism.

10. A fashion accessory tool, comprising:

a base plate having a first end and a second end;

an arm having a first end and a second end, wherein the first end of the arm is pivotally coupled with the first end of the base plate by a first extendable feature and the second end of the arm has a fastener configured to directly engage with a corresponding fastener on the second end of the base plate and a second extendable feature is between the second end of the base plate and the fastener on the second end of the base plate, wherein the base plate is substantially parallel to the arm;

a deformable band positioned between the arm and the base plate, wherein the band deforms when a piece of fabric is passed through the fashion accessory tool; and a pin mechanism, wherein a first end of the pin mechanism is pivotally attached to an end of the arm and a second end of the pin mechanism is configured to engage a feature attached to the other end of the arm.

11. The fashion accessory tool of claim 10, wherein the feature attached to the other end of the arm is a safety cap.

12. The fashion accessory tool of claim 10, wherein the arm has two openings through which the piece of fabric can be woven.

13. The fashion accessory tool of claim 10, wherein the fastener and corresponding fastener comprise a snap stud and snap socket arrangement.

14. The fashion accessory tool of claim 10, wherein the base plate has a decorative surface.

15. A fashion accessory tool, comprising:

a base plate having a first end and a second end;

an arm having a first end and a second end, wherein the first end of the arm is pivotally coupled with the first end of the base plate by a spring mechanism and the second end of the arm has a fastener configured to directly engage with a corresponding fastener on the second end of the base plate, wherein the base plate is substantially parallel to the arm, wherein the spring mechanism is a helical extension spring;

a deformable band positioned between the arm and the base plate, wherein the band deforms when a piece of fabric is passed through the fashion accessory tool; and a pin mechanism, wherein a first end of the pin mechanism is pivotally attached to an end of the arm and a second end of the pin mechanism is configured to engage a feature attached to the other end of the arm.

16. The fashion accessory tool of claim 15, wherein the feature attached to the other end of the arm is a safety cap.

17. The fashion accessory tool of claim 15, wherein the arm has two openings through which the piece of fabric can be woven.

18. The fashion accessory tool of claim 15, wherein the fastener and corresponding fastener comprise a snap stud and snap socket arrangement.

19. The fashion accessory tool of claim 15, wherein the base plate has a decorative surface.

* * * * *